US009447591B2

(12) United States Patent
McKay

(10) Patent No.: US 9,447,591 B2
(45) Date of Patent: Sep. 20, 2016

(54) TOOL FOR FINISHING AN OUTSIDE CORNER

(71) Applicant: Robert McKay, Aldergrove (CA)

(72) Inventor: Robert McKay, Aldergrove (CA)

( * ) Notice: Subject to any disclaimer, the term of this patent is extended or adjusted under 35 U.S.C. 154(b) by 0 days.

(21) Appl. No.: 14/487,040

(22) Filed: Sep. 15, 2014

(65) Prior Publication Data

US 2015/0167323 A1 Jun. 18, 2015

Related U.S. Application Data

(60) Provisional application No. 61/877,880, filed on Sep. 13, 2013.

(51) Int. Cl.
*E04F 21/16* (2006.01)
*E04F 21/165* (2006.01)

(52) U.S. Cl.
CPC ..... *E04F 21/161* (2013.01); *E04F 21/1655* (2013.01)

(58) Field of Classification Search
CPC ..... A47L 13/16; A47L 13/46; B05C 17/10; E04F 21/1652; E04F 21/1655; E04F 21/161
See application file for complete search history.

(56) References Cited

U.S. PATENT DOCUMENTS

| | | | | |
|---|---|---|---|---|
| 1,633,119 | A * | 6/1927 | MacKay | 15/210.1 |
| 1,660,351 | A * | 2/1928 | Pataki | 15/244.1 |
| 3,241,174 | A | 3/1966 | Callahan | |
| 3,872,536 | A * | 3/1975 | Siemund | 15/244.1 |
| 4,197,338 | A | 4/1980 | Perna | |
| 5,368,461 | A | 11/1994 | Murphy | |
| 5,695,788 | A | 12/1997 | Woods | |
| 5,774,924 | A | 7/1998 | Beckham et al. | |
| 5,792,489 | A | 8/1998 | Liberman | |
| 5,799,357 | A | 9/1998 | Taylor | |
| 5,954,571 | A | 9/1999 | Case | |
| 6,044,513 | A * | 4/2000 | Penn | 15/118 |
| 6,733,262 | B1 | 5/2004 | Denkins | |
| 7,409,740 | B1 * | 8/2008 | Geigan | 15/1.7 |
| 2006/0123577 | A1 * | 6/2006 | Luster | 15/210.1 |
| 2007/0094830 | A1 * | 5/2007 | Williams | 15/244.3 |
| 2011/0159790 | A1 | 6/2011 | Wilson | |
| 2011/0312250 | A1 | 12/2011 | Wilson | |

* cited by examiner

*Primary Examiner* — Randall Chin
(74) *Attorney, Agent, or Firm* — Cameron IP

(57) ABSTRACT

A tool for finishing an outside corner comprises a handle and a V-shaped blade coupled to the handle. The V-shaped blade has a pair of planar blade surfaces which each extend from a vertex thereof. A retaining mechanism releasably retains a sponge against the surfaces of the V-shaped blade.

1 Claim, 6 Drawing Sheets

TOOL FOR FINISHING AN OUTSIDE CORNER

BACKGROUND OF THE INVENTION

1. Field of the Invention

The present invention relates to a tool and, in particular, to a tool for finishing an outside corner.

2. Description of the Related Art

It is known to construct interior walls using drywall. It is also known to use corner bead to strengthen corners of interior walls constructed of drywall. Corner bead is generally in the form of a V-shaped, light gauge metal or paper strip which is installed on corners of the interior walls. It is therefore desirable to apply a finishing material to the corner bead to provide the corner with an even finish to facilitate painting. The finishing material is typically applied to the corner bead using a corner trowel. There is however also a need for a tool to evenly spread the finishing material applied to the corner bead or to remove excess finishing material applied to the corner bead.

SUMMARY OF THE INVENTION

There is provided a tool comprising a handle and a blade coupled to the handle. There is a retaining mechanism which releasably retains a sponge against the blade. The tool may further include a seat extending along a bottom of the blade and the sponge may sit on the seat. The retaining mechanism may include a catch which is an opening in the seat and a latch which is mounted on the blade.

There is also provided a tool comprising a handle and a V-shaped blade coupled to the handle. The V-shaped blade has a pair of planar blade surfaces which each extend from a vertex thereof. A retaining mechanism releasably retains a sponge against the planar blade surfaces of the V-shaped blade. The retaining mechanism may include a catch and a latch. There may be a seat extending along a bottom of the V-shaped blade and the sponge may sit on the seat. The catch may be an opening in the seat. The latch may be mounted at the vertex of the V-shaped blade.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
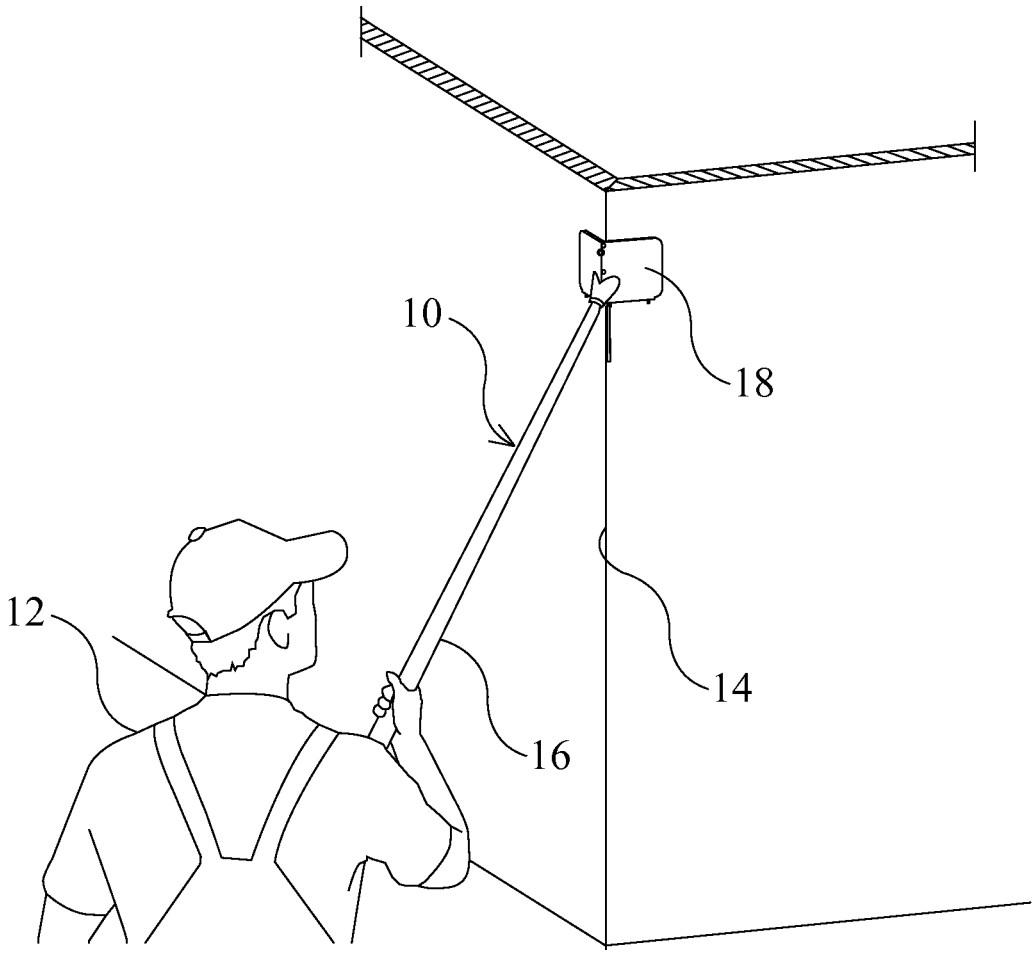
FIG. 1 is a perspective view showing a first embodiment of an improved tool being used to finish a right-angle outside corner of a wall.

Referring to the drawings and first to FIG. 1, there is shown an improved tool 10 which is being used by a person 12 to finish an outside corner 14 of a wall. The tool 10 generally comprises a handle 16 and a head 18. The handle 16 is elongate in this example and may have a fixed length or an adjustable length, e.g. the handle 16 may be a telescopic handle. The handle 16 may also be fixedly coupled or pivotably coupled to the head 18.

Figure 3:
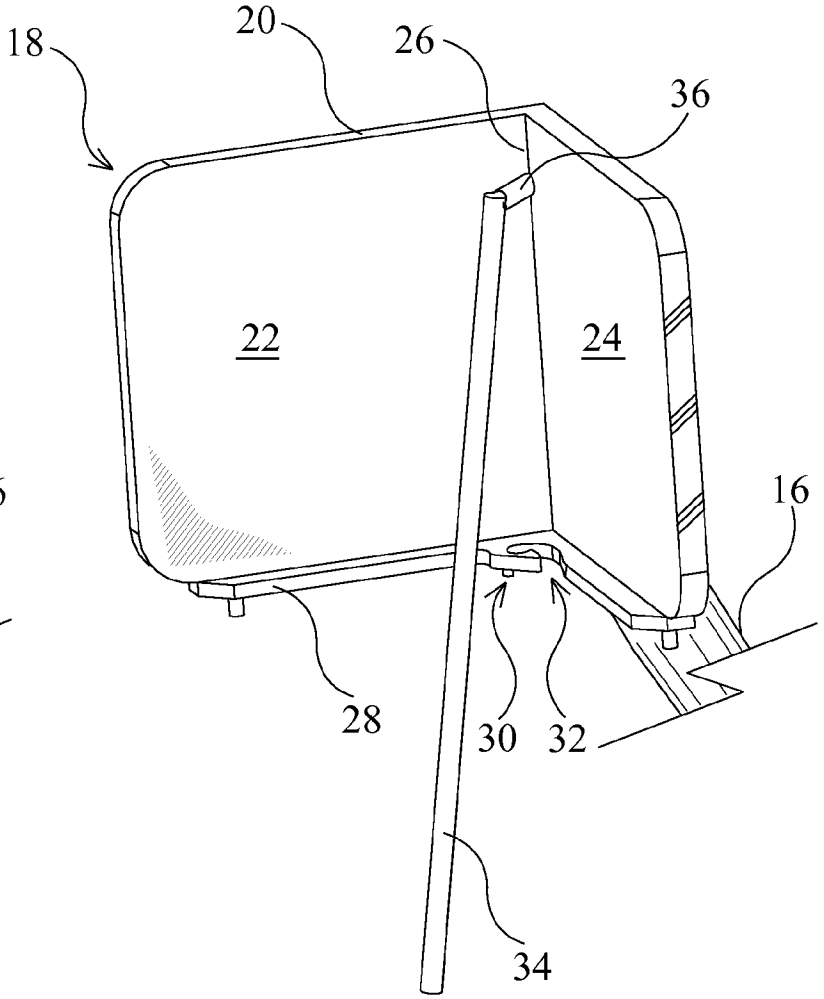
FIG. 3 is a front, perspective view of the head of the first embodiment of the tool showing the retaining mechanism thereof in a released position.
Figure 2:
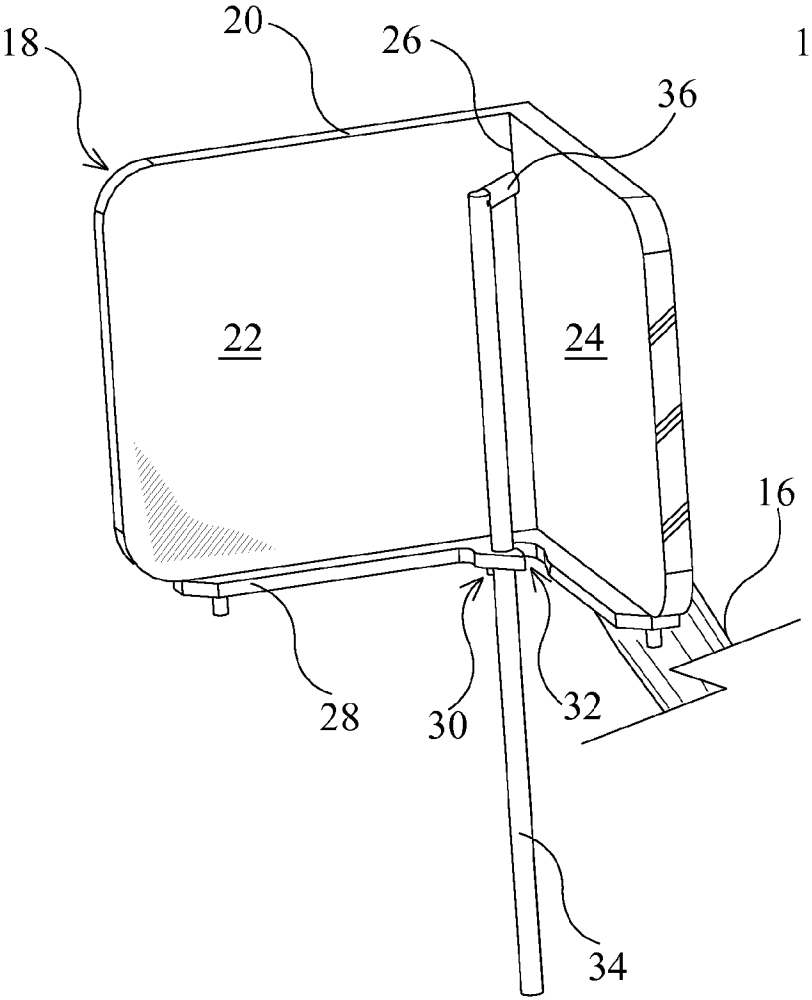
FIG. 2 is a front, perspective view of a head of the first embodiment of the tool showing a retaining mechanism thereof in an engaged position.

The head 18 is shown in greater detail in FIGS. 2 and 3. The head 18 includes a V-shaped blade 20 having a pair of planar blade surfaces 22 and 24 which each extend from a vertex 26 thereof. In this example, the blade surfaces 22 and 24 each have a substantially square profile and extend substantially perpendicular to one another. There is a seat 28 which extends along a bottom edge of the V-shaped blade 20. The seat is flange-like and extends inwardly and generally perpendicularly from the blade 20. The head 18 also includes a retaining mechanism 30 which is shown in an engaged position in FIG. 2 and in a released position in FIG. 3. The retaining mechanism 30 includes a catch 32 and a latch 34. The catch 32 in this example is a notch-like curved opening in the seat 28. The latch 34 in this example is a rod-like elongate member which is mounted on a projection 36 which extends outwardly from the vertex 26 of the V-shaped blade 20. The latch 34 may be moved into and out of engagement with the catch 32.

Figure 5:
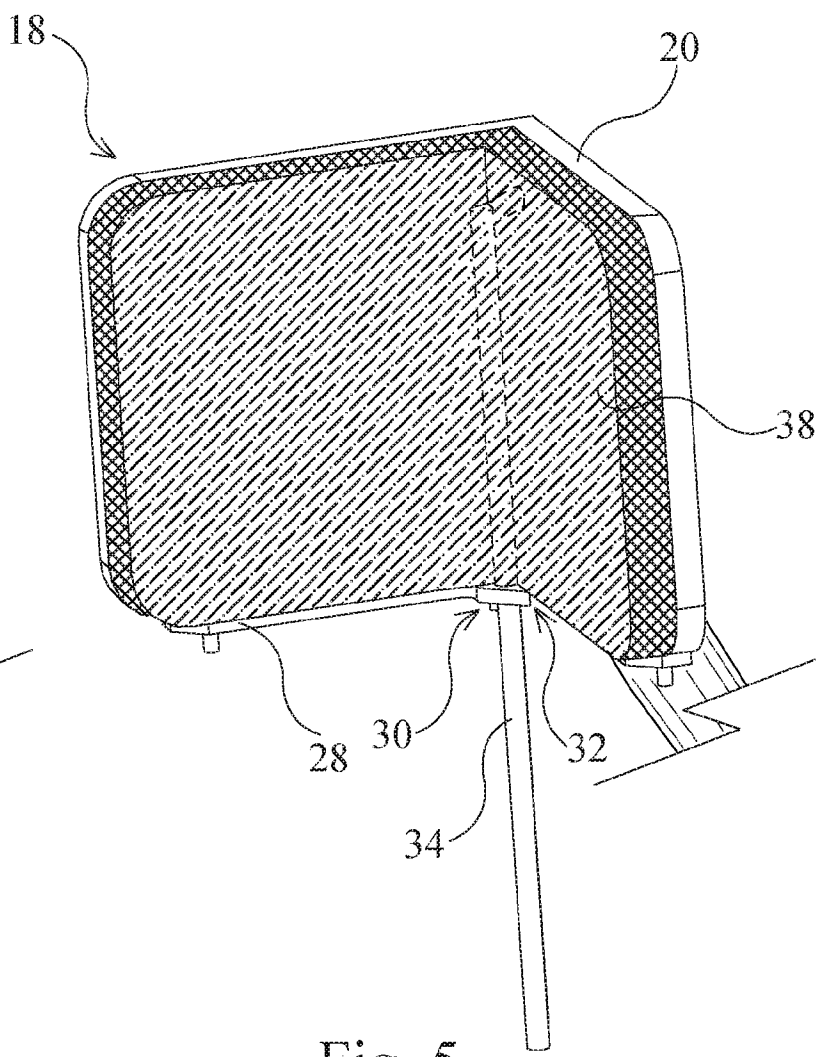
FIG. 5 is a front, perspective view of the head of the first embodiment of the tool showing a sponge disposed on a seat thereof and the retaining mechanism thereof in an engaged position.
Figure 4:
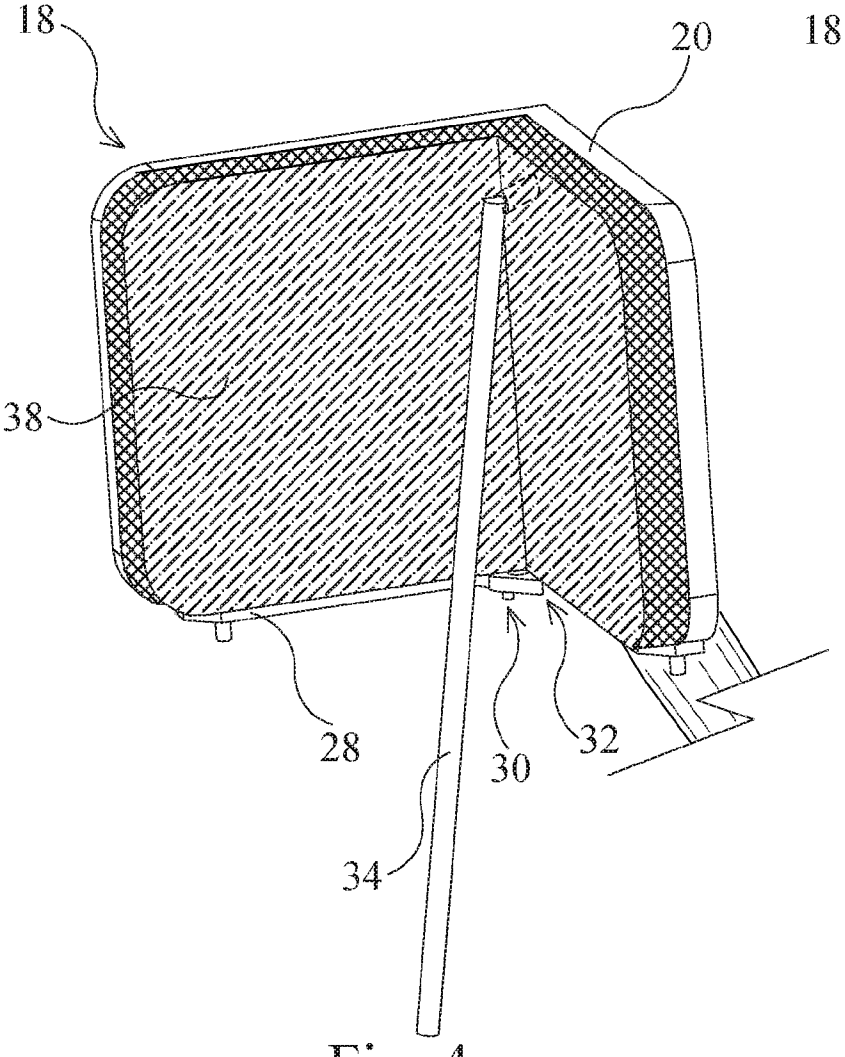
FIG. 4 is a front, perspective view of the head of the first embodiment of the tool showing a sponge disposed on a seat thereof and the retaining mechanism thereof in a released position.
Figure 6:
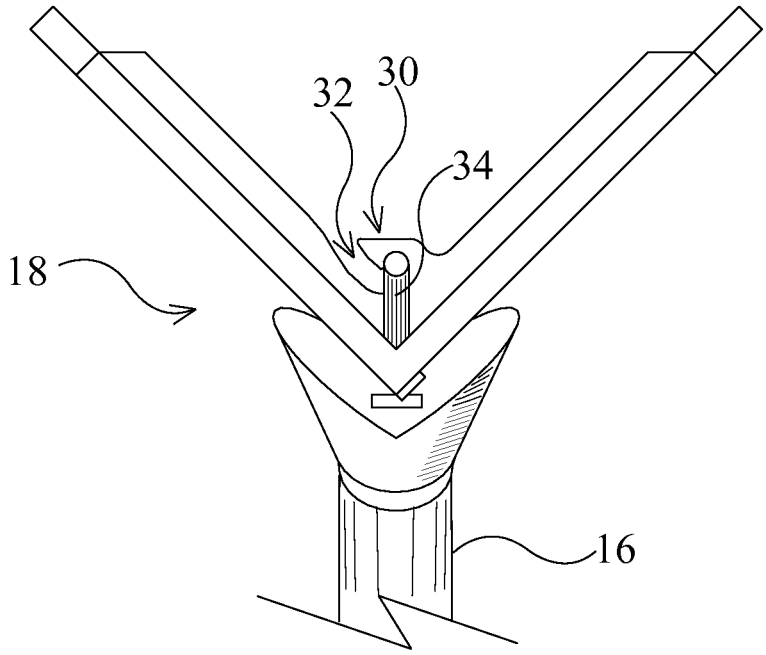
FIG. 6 is a top, plan view of the head of the first embodiment of the tool showing the retaining mechanism thereof in the engaged position and the handle thereof in fragment.
Figure 7:
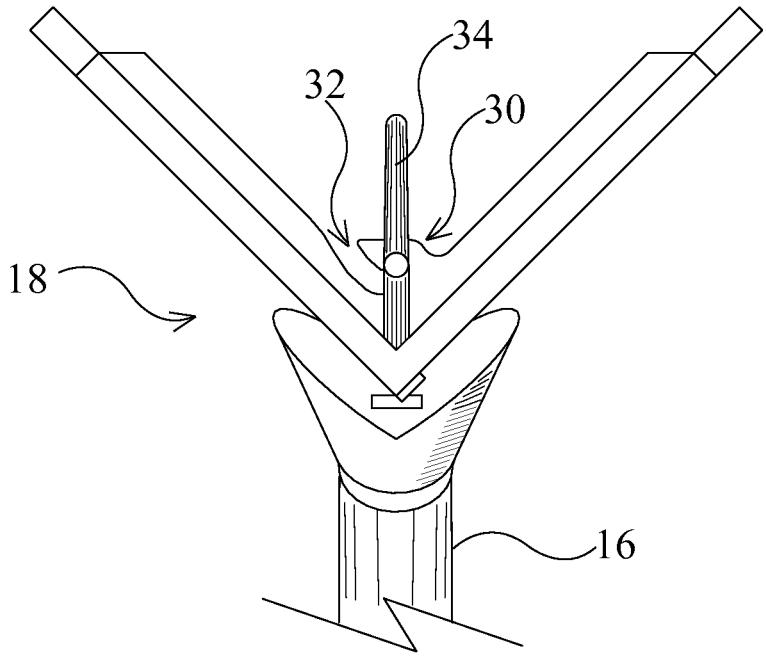
FIG. 7 is a top, plan view of the head of the first embodiment of the tool showing the retaining mechanism thereof in the released position and the handle thereof in fragment.
Figure 8:
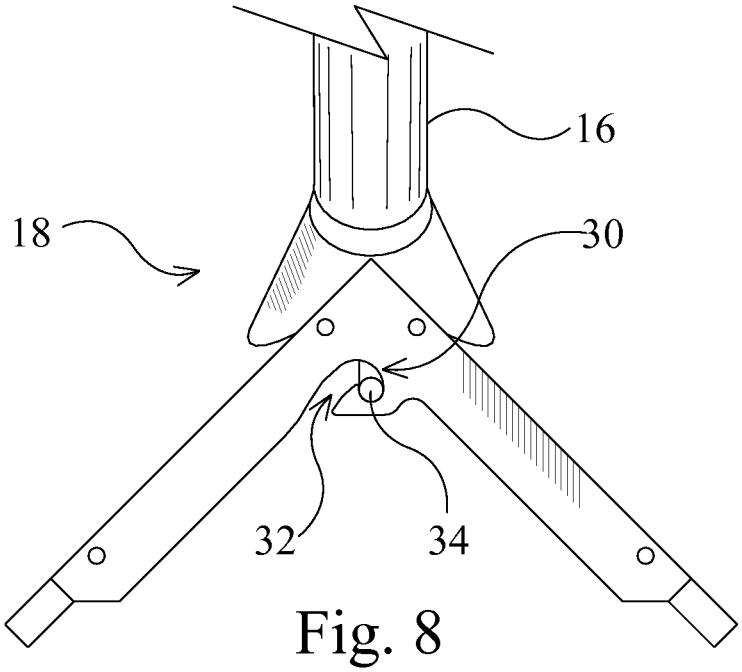
FIG. 8 is a bottom, plan view of the head of the first embodiment of the tool showing the retaining mechanism thereof in the engaged position and the handle thereof in fragment.
Figure 9:
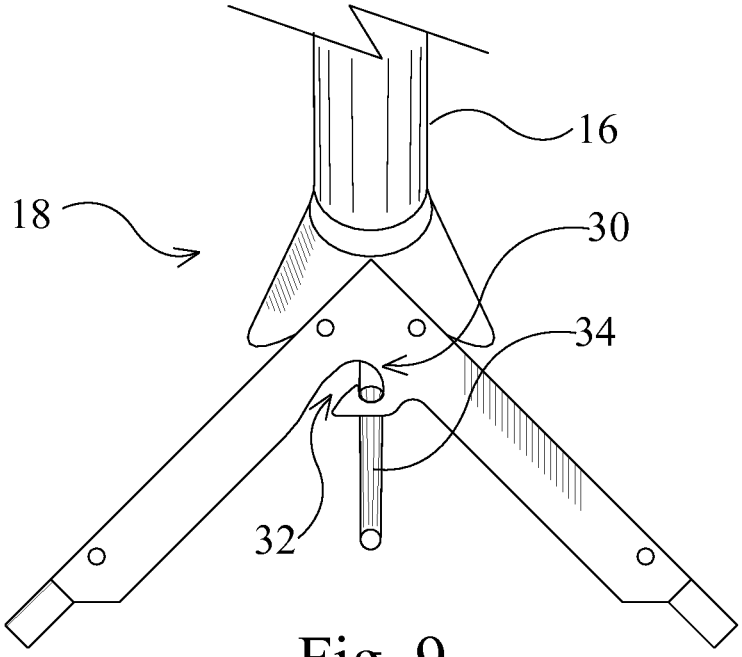
FIG. 9 is a bottom, plan view of the head of the first embodiment of the tool showing the retaining mechanism thereof in the released position and the handle thereof in fragment.

The retaining mechanism 30, as best shown in FIGS. 4 and 5, functions to releasably retain a sponge 38. The sponge 38 is similar in shape to the blade 20 in this example. FIG. 4 shows the retaining mechanism in the released position which allows the sponge 38 to rest on the seat 28 and against the V-shaped blade 20. The retaining mechanism 30 may then be moved to the engaged position to retain the sponge 38 in place as shown in FIG. 5. The latch 34 is engulfed by the sponge 38 in the engaged position and the sponge 38 may then be used to finish the corner 14, as shown in FIG. 1, without interference from the latch 34. The retaining mechanism 30 is moved between the engaged position and the released position by moving the latch 34 into and out of engagement with the catch 32 as shown in FIGS. 6 to 9.

In operation, finishing material may be applied to a drywall corner using an applicator or to corner bead using a hopper. The corner bead is then rolled to set the corner bead into place. This may result in excess finishing material being extruded which may be wiped away, using the tool disclosed herein, before finishing material starts to harden.

Figure 11:
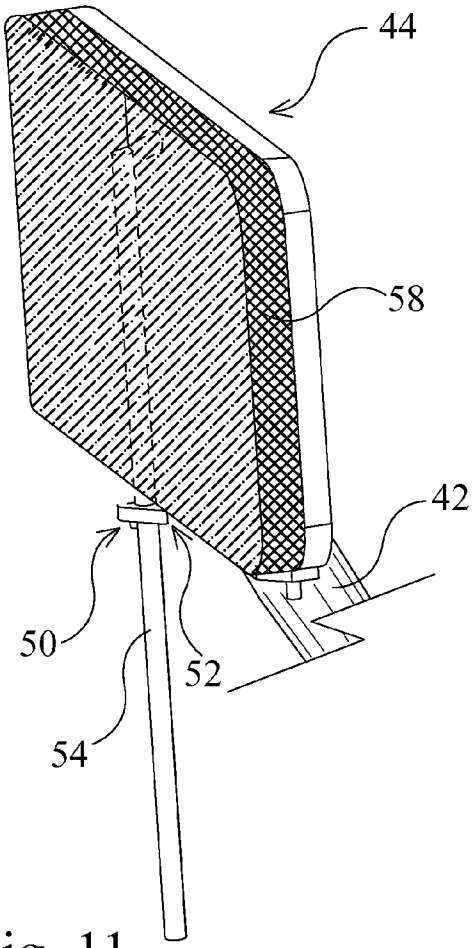
FIG. 11 is a front, perspective view of the head of second embodiment of the tool showing a sponge disposed on a seat thereof and the retaining mechanism thereof in an engaged position.
Figure 10:
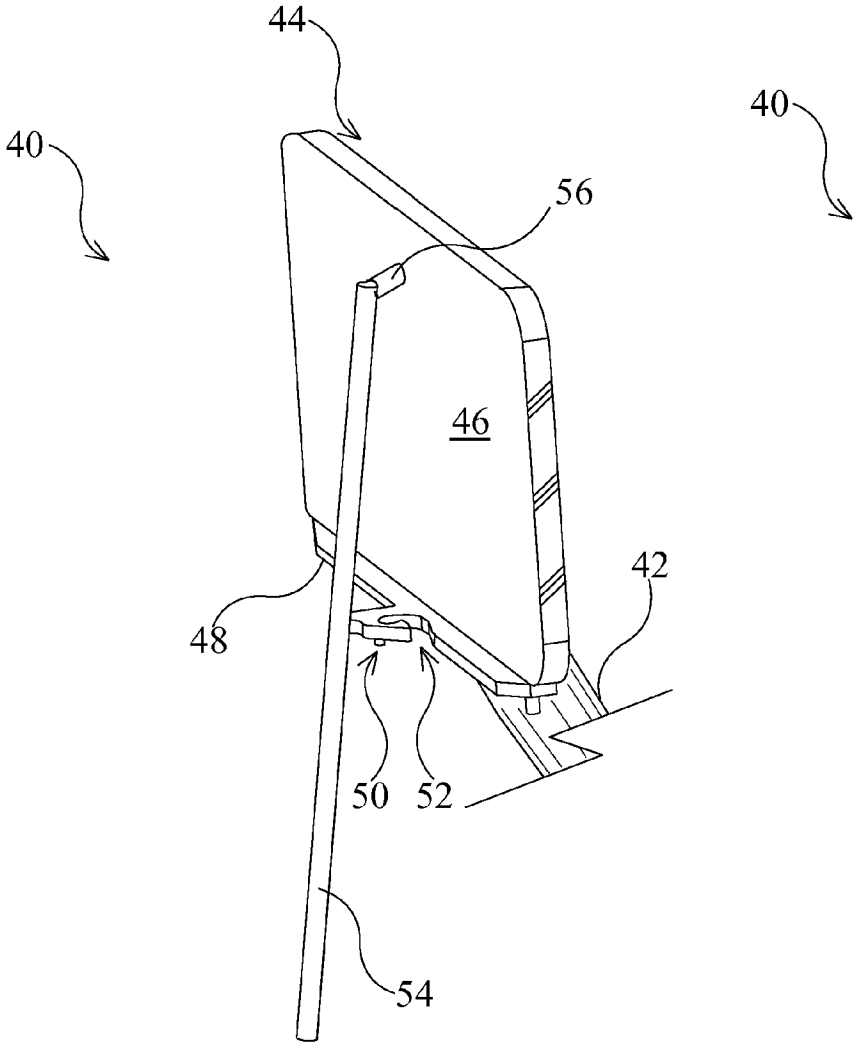
FIG. 10 is a front, perspective view of a head of a second embodiment an improved tool showing a retaining mechanism thereof in a released position.

FIGS. 10 and 11 show a tool 40 which comprises a handle 42 and a head 44. The handle 42 may be fixedly or pivotably coupled to the head 44. The head 44 includes a planar blade 46 and a seat 48 which extends generally perpendicular from the planar blade 46. The head 44 also includes a retaining mechanism 50 which includes a catch 52 and a latch 54. The catch 52 in this example is a notch-like curved opening in the seat 48. The latch 54 in this example is a rod-like elongate member which is mounted on a projection 56 which extends outwardly from the planar blade 46. The latch 54 may be moved into and out of engagement with the catch 52. FIG. 10 shows the retaining mechanism 50 in a released position and FIG. 11 shows the retaining mechanism 30 in an engaged position which retains a sponge 58 in place. It will accordingly be understood by a person skilled in the art that the blade may have any other suitable geometry.

It will also be understood by a person skilled in the art that many of the details provided above are by way of example only, and are not intended to limit the scope of the invention which is to be determined with reference to the following claims.

What is claimed is:

1. A tool comprising:

a handle;

a sponge;

a V-shaped blade coupled to the handle, the V-shaped blade having a pair of planar blade surfaces which each extend from a vertex thereof;

a seat extending along a bottom of the V-shaped blade, the sponge being mounted on the seat; and a retaining mechanism releasably retaining the sponge against the pair of planar blade surfaces of the V-shaped blade, wherein the retaining mechanism includes a catch which is an opening in the seat and a latch which is mounted on the V-shaped blade and wherein the latch is engulfed by the sponge when the retaining mechanism is in an engaged position.

* * * * *